US007364155B2

(12) United States Patent
Nagao et al.

(10) Patent No.: US 7,364,155 B2
(45) Date of Patent: Apr. 29, 2008

(54) SHEET FEEDING APPARATUS, IMAGE READING APPARATUS AND IMAGE FORMING APPARATUS

(75) Inventors: Hiroyuki Nagao, Yamabe-gun (JP); Takashi Nishida, Nara (JP); Kazuo Nakamura, Kashiba (JP); Sohichi Takata, Kitakatsuragi-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 24 days.

(21) Appl. No.: 10/772,771

(22) Filed: Feb. 4, 2004

(65) Prior Publication Data

US 2004/0212139 A1 Oct. 28, 2004

(30) Foreign Application Priority Data

Feb. 6, 2003 (JP) ..... 2003-030134

(51) Int. Cl.
*B65H 29/00* (2006.01)
*B65H 29/68* (2006.01)
*B65H 1/08* (2006.01)

(52) U.S. Cl. ..... 271/186; 271/69; 271/126; 271/157 B; 271/6; 271/5; 399/367

(58) Field of Classification Search ..... 271/157, 271/126, 127, 110, 69, 10.01, 225, 184, 186; 399/367, 371, 372
See application file for complete search history.

(56) References Cited

U.S. PATENT DOCUMENTS 5,552,859 A * 9/1996 Nakagawa et al. ..... 399/23
6,059,279 A * 5/2000 Wenthe, Jr. ..... 271/10.13
6,091,927 A * 7/2000 Hattori et al. ..... 399/367
6,279,893 B1 * 8/2001 Ohkawa et al. ..... 271/10.12
6,585,258 B1 * 7/2003 Hirota et al. ..... 271/186

FOREIGN PATENT DOCUMENTS

JP 07-017640 1/1995
JP 10-250853 9/1998
JP 11-199065 7/1999
JP 11-237771 8/1999

* cited by examiner

*Primary Examiner*—Gene O. Crawford
*Assistant Examiner*—Rakesh Kumar
(74) *Attorney, Agent, or Firm*—George W. Neuner; David G. Conlin; Edwards Angell Palmer & Dodge LLP

(57) ABSTRACT

In a standby state wherein a document is set in a document tray and can be supplied when needed, when a start signal is not inputted (S21: NO), a controller determines whether a document regulating plate has been operated or not based on a detection output of a document size detector for detecting a position of the document regulating plate (S31), and when the document regulating plate was operated (S31: YES), the controller lowers the document tray by a predetermined amount and stops it (S32). A lowered amount of the document tray can be arbitrarily set by a user through an operator control panel. With a sheet feeding apparatus, an image reading apparatus and an image forming apparatus constituted as described above, even in a state in which the document is set in the document tray, the set state can be easily canceled by operating the document regulating plate.

16 Claims, 10 Drawing Sheets

SHEET FEEDING APPARATUS, IMAGE READING APPARATUS AND IMAGE FORMING APPARATUS

This Nonprovisional application claims priority under 35 U.S.C. § 119(a) on Patent Application No.2003-030134 filed in Japan on Feb. 6, 2003, the entire contents of which are hereby incorporated by reference.

BACKGROUND OF THE INVENTION

1. Field of the Invention

The present invention relates to a sheet feeding apparatus mounted on an image reading apparatus such as a copying machine and a scanning apparatus, or an image forming apparatus such as a printer and a facsimile apparatus, for sequentially taking in a sheet such as a document contained in a stacked state in sheet containing means and supplying and conveying it to a conveyance path. The invention also relates to an image reading apparatus and an image forming apparatus provided with the sheet feeding apparatus.

2. Description of Related Art

Recently, an apparatus which automatically takes in a sheet of document one by one, conveys it and sequentially reads an image of the document is mounted on an image forming apparatus or the like in order to efficiently read the image or to form an image based on the read image. In the meantime, as digital technology has been developed, the speed of image reading from the document, of conversion from the read data to electronic data and of image formation from the electronic data is increased. According to such a reading apparatus, in order to perform processing for the larger number of documents at high speed, the number of documents which can be set once is increased to as many as 100 to 200 sheets. Then, even when the number of sheets loaded is increased, in order to uniformly provide a taking-out condition by sheet supplying and conveying means, sheet containing means is enabled to be elevated or lowered by elevation/lowering driving means and controlling means controls the elevation/lowering driving means to maintain an upper surface height of the sheet at a predetermined height (referring to Japanese Patent Application Laid-Open Nos. 11-237771 (1999), 10-250853 (1998) and 7-17640 (1995), for example). In addition, as a document conveying unit in a document reading apparatus has been developed, kinds of the documents which can be conveyed are diversified.

However, according to the above apparatus which can set many sheets, when the sheet containing means is put on standby at the lowest position, capacity of the sheets can be increased, but it takes time to elevate the sheet conveying means in order to put the sheet containing means into a state in which the document can be supplied to a conveyance path, after a start signal for reading was received through a key operation or the like. Consequently, there is a problem that a total reading time for reading the document is increased.

Thus, in order to solve such a problem, according to Japanese Patent Application Laid-Open No. 11-237771, for example, a tray is automatically elevated when a predetermined time passed after it was detected that the document was set in the tray serving as the sheet containing means, and the tray is controlled so that elevation is completed before a document reading signal is outputted, to decrease the total reading time. However, according to the prior art, when it becomes necessary to check the document, add or reduce the document, correct a set state of the document (when it is not set straight or the like) or the like after the document was set, since the document is in a state pressed by a guide-in roller, there is a problem that the above operations cannot be easily performed.

Normally, in such a case, the user pulls out the document by force. At this time, however, the document could be damaged or contaminated or the guide-in roller could be damaged, which is not preferable. In this respect, it can be considered that a key for lowering the tray is provided in the operation panel or the like, but there is a problem that the user is not likely to notice the key.

Then, as another prior art, according to Japanese Patent Application Laid-Open No. 10-250853, an upper surface height of the document is detected and the document is put on standby at the height in the vicinity of the higher limit in which the document is not in contact with a guide-in roller. However, according to this prior art, although the document can be pulled out or aligned, there is a problem that it is sometimes difficult to add the document and a sensor is necessary.

BRIEF SUMMARY OF THE INVENTION

The present invention was made in view of the above circumstances and it is an object of the present invention to provide a sheet feeding apparatus, an image reading apparatus and an image forming apparatus in which a sheet can be easily aligned, added or the like without damaging the sheet and sheet containing means even after containing of the sheet is finished.

A sheet feeding apparatus according to the present invention comprises: sheet containing means for containing a plurality of stacked sheets; elevation/lowering driving means for elevating and lowering the sheet containing means; and sheet conveying means for taking out sheets sequentially from an uppermost layer put in contact with the sheet conveying means by elevating the sheet containing means by the elevation/lowering driving means and conveying the sheets to a predetermined conveyance path. The sheet feeding apparatus further comprises: regulating means provided so as to be slidable on the sheet containing means for regulating a set position of the sheet; position detecting means for detecting a position of the regulating means; and contact detecting means for detecting a contact state between the uppermost layer of the sheets contained in the sheet containing means and the sheet conveying means. The elevation/lowering driving means lowers the sheet containing means when a change in the position of the regulating means is detected by the position detecting means in a state in which the uppermost layer of the sheets contacts the sheet conveying means.

According to the present invention, when the regulating means provided so as to be sidable on the sheet containing means for regulating the set position of the sheet is operated in the state in which an uppermost layer of the sheets contained in the sheet containing means contacts the sheet conveying means, that is, after the sheet was set once so as to be supplied and conveyed, the sheet containing means is lowered by the elevation/lowering driving means. Therefore, even when setting of the sheet is completed once, since the set state can be canceled only by operating the regulating means, operations for stopping the supplying and conveying operation, for aligning the sheet and for reducing or adding the sheet can be easily performed. Furthermore, the sheet can be prevented from being contaminated and the guide-in roller or the like provided at the sheet conveying means can be prevented from being damaged.

According to the sheet feeding apparatus of the present invention, the elevation/lowering driving means may lower the sheet containing means until the uppermost layer of the sheets and the sheet conveying means are separated, when the position detecting means detects a change in the position of the regulating means.

According to the present invention, when a change in the position of the regulating means is detected, the sheet containing means is lowered until the uppermost layer of the contained sheets and the sheet conveying means are separated. Therefore, since the lowered amount of the sheet containing means can be the bare minimum of amount (several mm, for example) in which the uppermost layer of the sheets is completely separated from the guide-in roller provided in the sheet conveying means, when supplying of the sheet is started in the state in which the sheet containing means is lowered, a time taken to elevate the sheet containing means again to realize the state in which the sheet can be supplied can be the minimum. In addition, in the state in which the sheet containing means is lowered, since the uppermost layer of the sheets is completely separated from the guide-in roller provided in the sheet conveying means, the sheet can be easily pulled out, easily aligned or the like as well as the sheet can be surely prevented from being contaminated and the guide-in roller can be surely prevented from being damaged.

The sheet feeding apparatus according to the present invention may further comprises receiving means for receiving information according to a lowered amount of the sheet containing means and storing means for storing the received information. In this case, the elevation/lowering driving means lowers the sheet containing means by the lowered amount stored in the storing means when the position detecting means detects a change in the position of the regulating means.

According to the present invention, the lowered amount of the sheet containing means can be previously set, and when the sheet containing means is lowered, the sheet containing means is lowered by the set lowered amount. Therefore, the lowered amount can be set according to the number of documents which is frequently set in the normal and general usage state. In addition, in the state in which the sheet containing means is lowered, since the uppermost layer of the sheets is completely separated from the guide-in roller provided in the sheet conveying means, the sheet can be easily pulled out, easily aligned or the like as well as the sheet can be surely prevented from being contaminated and the guide-in roller can be surely prevented from being damaged.

The sheet feeding apparatus according to the present invention may further comprise measuring means for measuring a dimension of the sheet contained in the sheet containing means based on a detection result of the position detecting means.

According to the present invention, there is provided measuring means for measuring the dimension of the sheet contained in the sheet containing means based on the detection result of the position detecting means for detecting the position of the regulating means. Therefore, when a slide volume constituted so that a resistance value is continuously changed in accordance with the position of the regulating means is used, for example, as the measuring means for measuring the dimension of the sheet, the operation of the document regulating plate when the sheet is added, reduced or the like can be detected, unlike the light sensor or the like in which a detection output is obtained only at the defined size position. That is, the means for detecting the dimension of the sheet can be used also as means for detecting the position of the regulating means.

The sheet feeding apparatus according to the present invention may further comprise clocking means. In this case, the sheet containing means is elevated when a change in the position of the regulating means is not detected for a predetermined time.

According to the present invention, the sheet containing means is elevated when the operation of the regulating means is not performed for the predetermined time. Therefore, the elevating operation of the sheet containing means can be stopped while the regulating means is being operated and then the sheet containing means is elevated when the operation of the regulating means is completed. As a result, the operation can be performed safely.

An image reading apparatus of the present invention comprises a sheet feeding apparatus according to the present invention and image reading means for reading an image on a sheet conveyed by sheet conveying means.

According to the present invention, even after the sheet was set once, the set state can be canceled only by operating the regulating means when the supplying and conveying operation is stopped, the sheet is aligned and the sheet is added or reduced. Therefore, those operations can be easily performed and the image on the sheet conveyed by the sheet conveying means can be read.

An image forming apparatus of the present invention comprises a sheet feeding apparatus according to the present invention and image forming means for forming an image on a sheet conveyed by sheet conveying means.

According to the present invention, even after the sheet was set once, the set state can be canceled only by operating the regulating means when the supplying and conveying operation is stopped, the sheet is aligned and the sheet is added or reduced. Therefore, those operations can be easily performed and the image can be formed on the sheet conveyed by the sheet conveying means.

An image forming apparatus of the present invention comprises an image reading apparatus according to the present invention and image forming means for forming an image on a sheet conveyed by sheet conveying means.

According to the present invention, even after the sheet was set once, the set state can be canceled only by operating the regulating means when the supplying and conveying operation is stopped, the sheet is aligned and the sheet is added or reduced. Therefore, those operations can be easily performed and the image reading and forming on the sheet conveyed by the sheet conveying means can be performed.

The above and further objects and features of the invention will more fully be apparent from the following detailed description with accompanying drawings.

DETAILED DESCRIPTION OF THE INVENTION

The following description will explain the present invention in detail with reference to the drawings illustrating some embodiments thereof.

First Embodiment

Figure 1:
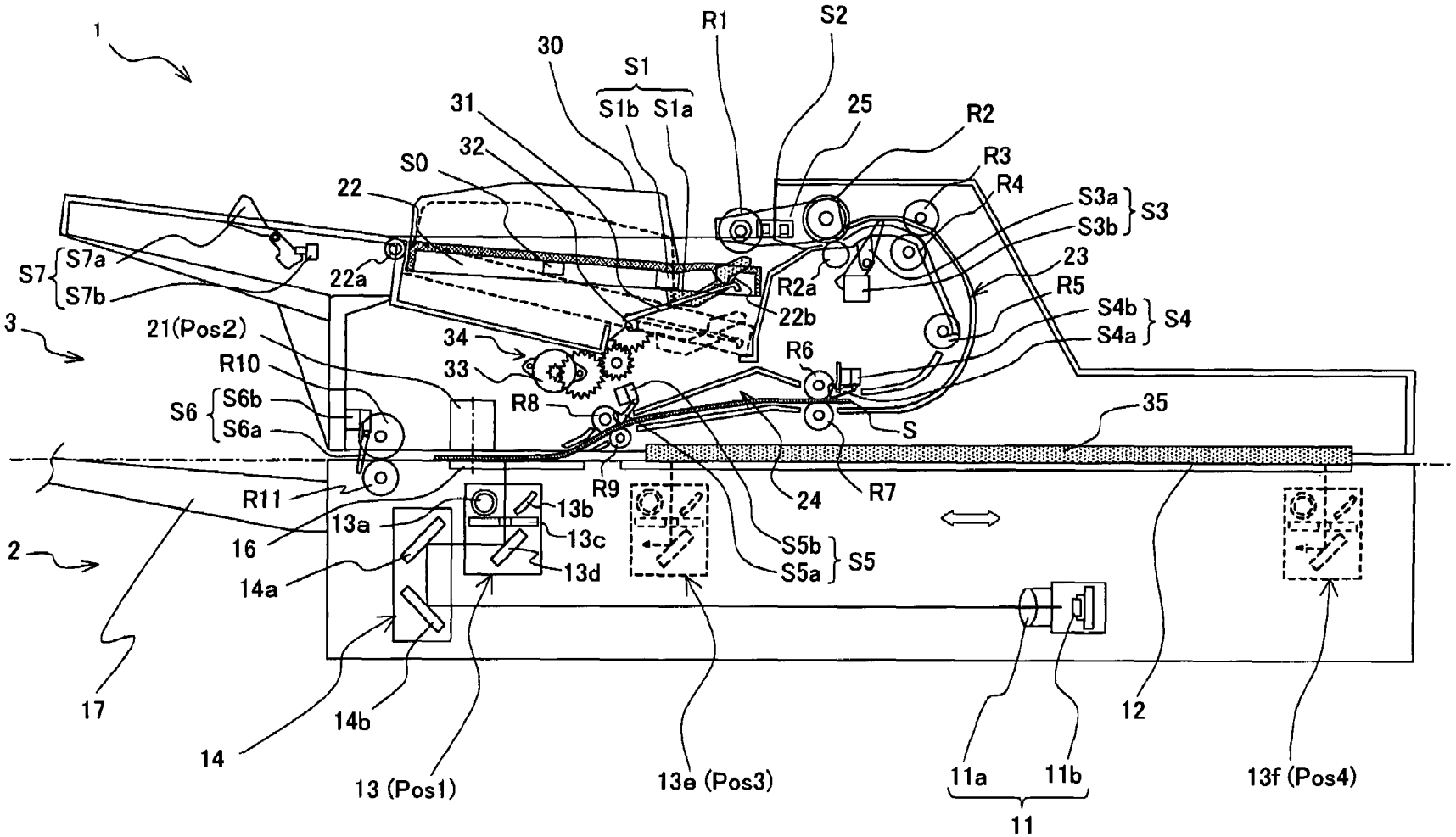
FIG. 1 is a vertical sectional view showing a whole constitution of an image reading apparatus according to an embodiment of the present invention.

FIG. 1 is a vertical sectional view showing a whole constitution of an image reading apparatus according to this embodiment. In FIG. 1, an image reading apparatus 1 roughly comprises an optical system 2 and an ADF (Automatic Document Feeder) 3 provided thereon and it is used as a scanner apparatus which can read images formed on both sides of a document.

The optical system 2 comprises a CCD (Charge Coupled Device) reading unit 11 serving as first reading means, a light source unit 13, and a mirror unit 14. An image of a document set on a document table 12 made of platen glass and supported on a plane is read by the CCD reading unit 11 provided at a predetermined position, using the light source unit 13 and the mirror unit 14. The CCD reading unit 11 comprises an imaging lens 11*a* and a CCD 11*b* and reflected light from the document passed through each section to be described later is focused on the CCD 11*b* through the imaging lens 11*a*.

The light source unit 13 comprises: an exposure lamp 13*a*; a concave reflector 13*b* which condenses illumination light for reading which is irradiated from the exposure lamp 13*a*, to a predetermined reading position on the document table 12; a slit 13*c* which passes only the reflected light from the document; and a mirror 13*d* having reflection surface set at an angle of 45° from a surface of the document table 12 in order to change a direction of a light path passed through the slit 13*c* by 90°.

The mirror unit 14 comprises a pair of mirrors 14*a* and 14*b* arranged such that the reflection surfaces may be at right angles to each other in order to further change the direction of the light path by 180° which was changed by 90° by the mirror 13*d* of the light source unit 13.

The light source unit 13 is moved in the direction (secondary scanning direction) shown by an outline arrow in the drawing parallel to the surface of the document table 12 as shown by reference signs 13*e* and 13*f*, and the mirror unit 14 is also moved in the direction shown by the outline arrow, so that the image of the document set on the document table 12 can be read. In addition, at this time, it is necessary to reduce the movement speed of the mirror unit 14 to half of the movement speed of the light source unit 13. The light source unit 13 and the mirror unit 14 are moved by a stepping motor (see FIG. 2).

Furthermore, the CCD reading unit 11 may have a constitution such that light irradiated from the exposure lamp 13*a* and reflected by the document is focused on the CCD 11*b* through the imaging lens 11*a*, while a unit of a miniature reading optical system (or one to one reading optical system) constituted as one unit of at least an imaging lens 11*a*, a CCD 11*b* and the exposure lamp 13*a* performs scanning in the secondary scanning direction.

In addition, another document table 16 is provided at a position spaced from the document table 12 in the secondary scanning direction in the optical system 2. The light source unit 13 can read the image on one surface (referred to as a front surface hereinafter) of the document being conveyed on the document table 16 while it is in a stationary state under the document table 16. A sheet discharge tray 17 is provided in the vicinity of an outlet of the document conveyed on the document table 16.

In the meantime, the ADF 3 comprises a CIS (Contact Image Sensor) 21 serving as second reading means, at a position opposed to the document table 16. The ADF 3 takes in the documents set in a stacked state on a document tray 22 one by one and makes the CIS 21 read the image on the other surface (referred to as a back surface hereinafter) of the document. Therefore, the ADF 3 further comprises various kings of rollers R1 to R10, detectors S1 to S7, a curved conveyance path 23 and a resist/skew correction area 24.

In addition, the CIS 21 comprises image sensors arranged in the form of an array, light leading means (a lens array such as a selfoc lens), a light source (light source of LED array or fluorescent light) and the like.

Figure 2:
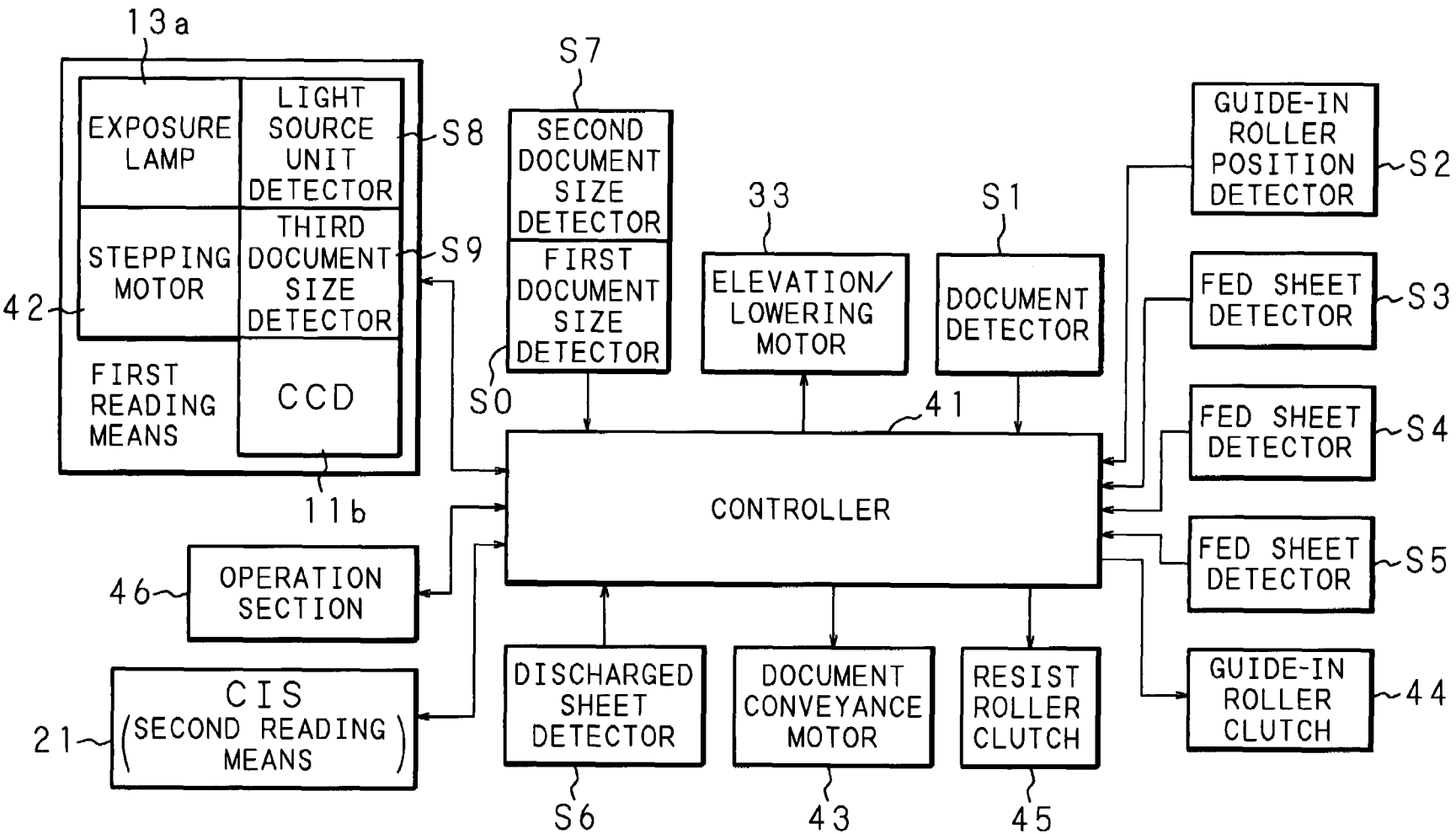
FIG. 2 is a block diagram showing a functional constitution of the image reading apparatus according to the embodiment of the present invention.

The various kinds of the roller R1 to R10 are driven by a document conveyance motor (see FIG. 2). In addition, although the detail is described later, a guide-in roller clutch (see FIG. 2) is connected to a guide-in roller R1 and a separating roller R2 connected to transmission means such as a belt, and a resist roller clutch (see FIG. 2) is connected to one of the resist rollers R8 and R9. When these clutches are connected or disconnected under control of a controller (see FIG. 2) to be described later, driving force of the document conveyance motor is transmitted to the guide-in roller R1, the separating roller R2 and the resist rollers R8 and R9 or cut off.

The document tray 22 is an electrically-operated tray. When an optical document detector S1 comprising an actuator S1*a* and a sensor body S1*b* detects that the document is set, the document tray 22 starts to elevate at a predetermined timing and an uppermost layer of the document bundle set therein pushes up the guide-in roller R1. The guide-in roller R1 is supported by an arm 25 so as to be able to be freely displaced in the vertical direction. When a guide-in roller position detector S2 detects the displacement of the guide-in roller R1, that is, that the guide-in roller is pushed up, elevating operation of the document tray 22 is stopped once and the document tray 22 is put into a standby state.

After the document was set in the document tray 22 and the document tray 22 is put into the standby state as described above, when a predetermined time has passed before a signal for starting the reading is inputted, the standby state may be continued as it is. However, it is desirable to prevent deformation of the guide-in roller R1 by lowering the document tray 22 to a predetermined position to wait.

When a sheet feeding start signal is inputted, the guide-in roller R1 and the separating roller R2 are rotated and sequentially take in the documents from the uppermost layer of a document bundle. The separating rollers R2 and R2*a* are arranged downstream of the guide-in roller R1. The guide-in roller R1 is supported by the arm 25 and the arm 25 is supported by a rotation axis of the separating roller R2 so that it can be turned. The guide-in roller R1 comes into contact with the uppermost document set in the document tray 22 by its own weight. In addition, the guide-in roller R1 is prevented from going down more than necessity by a stopper (not shown). As described later, a convex portion is formed at the arm 25 and a height of the guide-in roller R1 can be detected from an oscillating angle of the arm 25, by the guide-in roller position detector S2 constituted of a light sensor and the like.

Although the convex portion is provided at the arm 25 and the guide-in roller position detector S2 is arranged to directly detect the height position of the guide-in roller R1 in this embodiment, the guide-in roller position detector S2 may be provided at a position separated from the arm 25. In this case, the height position of the arm 25 is detected using movable connecting means.

The separating roller R2 is provided so as to be opposed to the separating roller R2*a* provided with a torque limiter (or may be opposed to a friction pad instead). Therefore, even when a plurality of documents are taken in by the guide-in roller R1, only the uppermost document attached to the guide-in roller R1 is taken in by the separating rollers R2 and R2*a*, so that the plural documents are not conveyed but they are surely separated and conveyed one by one.

In addition, it is detected whether the document is surely separated and supplied by the separating rollers R2 and R2*a* or not by a fed sheet detector S3 comprising an actuator S3*a* and a sensor body S3*b*. The document is conveyed to the downstream curved conveyance path 23 at a predetermined timing.

In the curved conveyance path 23, the document is conveyed by conveyance rollers R3 through R7 and it is detected whether the document is naturally conveyed or not by a fed sheet detector S4, comprising an actuator S4*a* and a sensor body S4*b*, for detecting that the document is discharged from the curved conveyance path 23. The curved conveyance path 23 has curvature so as to be able to convey various kinds of documents stably, that is, so as to be able to smoothly convey the thickest or hardest document among the readable documents.

The document discharged from the curved conveyance path 23 is conveyed to a resist/skew correction area 24. When a leading edge of the document is detected by a fed sheet detector S5 disposed before the resist rollers R8 and R9 provided in the vicinity of the outlet of the resist/skew correction area 24, the leading edge of the document contacts a contact portion between the resist rollers R8 and R9 by conveyance force from the upstream side for a predetermined time in a state in which the resist rollers R8 and R9 are stopped, so that resist and skew are corrected. The fed sheet detector S5 comprises an actuator S5*a* and a sensor body S5*b*.

In the resist/skew correction area 24 from the conveyance rollers R6 and R7 positioned downstream of the curved conveyance path 23 to the resist rollers R8 and R9, the resist/skew correction area 24 is designed such that the document S becomes almost linear between the conveyance rollers R6 and R7 and the resist rollers R8 and R9 and can be free from a guide surface of the conveyance path as completely as possible so as to be able to perform the resist and skew correction of the document as described above. Furthermore, a distance between the conveyance rollers R6 and R7 and the resist rollers R8 and R9 is set so as to secure a length of the smallest document in the conveyance direction at minimum among documents which can be processed in the document feeding apparatus. In other words, as a rear edge portion left in the curved conveyance path 23 is short, the correction of the resist and the skew of the document can be smoothly performed.

The document for which the resist and skew correction were performed at the resist/skew correction area 24 is conveyed again at a predetermined timing to a first reading position Pos1 for exposure scanning of the front surface of the document. Then, the document passes through a second reading position Pos2 for exposure scanning of the back surface of the document. The light source unit 13 faces the first reading position Pos1 and the ICS 21 faces the second reading position Pos2.

Thus, the document from which the image on the front surface or both surfaces was read is discharged to a sheet discharge tray 17 supported at a side surface of the image reading apparatus 1 at a position lower than the document discharged point, by the discharging rollers R10 and R11 (the discharge roller R11 is provided on the side of the optical system 2). Confirmation of this document discharging operation is detected by a discharged sheet detector S6 comprising an actuator S6*a* and a sensor body S6*b*.

The above operations are sequentially repeated until there is no document set in the document tray 22, and all the documents for which the reading was completed are sequentially discharged onto the sheet discharge tray 17.

Meanwhile, since the height of the document bundle set in the document tray 22 is lowered each time the document is sequentially supplied, it is controlled such that the document tray 22 is elevated by a lowered amount of the guide-in roller R1 so as to keep a predetermined height relation between the uppermost layer of the document bundle and the guide-in roller R1. Therefore, the document tray 22 can be oscillated around a fulcrum 22*a*. The fulcrum 22*a* is elevated when a rib 22*b* provided at an end opposite to the fulcrum 22*a* is pushed up by an elevation/lowering plate 31, and reversely, the rib 22*b* is lowered when the elevation/lowering plate 31 falls down. The end of the elevation/lowering plate 31 opposite to the rib 22*b* is fixed to a plate supporting shaft 32. The plate supporting shaft 32 is rotated by an elevation/lowering motor 33 through a elevation/lowering mechanism section 34 comprising a transmission member (gear) array.

The position of the document tray 22 in the standby state is maintained because the controller (see FIG. 2) to be described later controls to drive the elevation/lowering motor 33 of the elevation/lowering mechanism section 34, based on the detection signal of the guide-in roller position detector S2. The position of the document tray 22 in the standby state can be arbitrarily set through an operation section (see FIG. 2) to be described later by a user or a service person, in accordance with the number of documents which is frequently set in the document tray 22 in a normal and general usage state.

Furthermore, the document tray 22 can be vertically displaced between a height position at an inlet and a height position at an outlet of the curved conveyance path 23 which are inevitably formed by the curved conveyance path 23 set so as to secure the stable conveyance of the document as described above. When the document tray 22 is lowered in this range, since a distance between the document tray 22 and the guide-in roller R1 becomes large, a large amount of the documents can be set, and the document can be sequentially fed by elevating the uppermost layer of the large amount of the documents set on the document tray 22 up to the inlet of the curved conveyance path 23.

A document regulating plate 30 for regulating the set position of the document so as to align side portions of the document is provided at the document tray 22. The position of the document regulating plate 30 is detected by a first document size detector S0 for detecting a lateral width of the document (a length in the direction perpendicular to the feeding direction of the document). A second document size detector S7 comprising an actuator S7*a* and a sensor body S7*b* for detecting a length of the document (a length in the feeding direction of the document) is also provided at the document tray 22. The first and second document size detectors S0 and S7 detect the size of the document set on the document tray 22. A sheet at the time of the image formation is selected or the like based on this detection result and this detection result can be used for controlling the height position of the document tray 22 by the controller to be describe later.

In the meantime, when the document on the document table 12 is read, the light source unit 13 is moved by a predetermined distance in accordance with the document size detected by a third document size detector (see FIG. 2) for detecting the size of the document set on the document table 12, in the direction from a position Pos3 (a start position of the light source unit 13 when a still position is read) to a position Pos4 (a return position of the light source unit 13 when the maximum document is read) in FIG. 1.

Alternatively, when the document being conveyed is read, the light source unit 13 is stopped at the first reading position Pos1 (the position of the light source unit 13 when the running document is read). In addition, the light source unit 13 has a home position at the middle point between the positions Pos3 and Pos4 or at the middle point between the positions Pos3 and the first reading position Pos1, based on the detection result of a light source unit detector (see FIG. 2) serving as the position detector of the light source unit 13. Therefore, when the light source unit 13 is not used, that is, in the standby state, it is stopped at the home position.

Here, the ADF 3 is supported so as to be able to turn around a hinge (not shown) provided at a back side (back side of the sheet) between the image reading apparatus 1 and the optical system 2 in order to read the document on the document table 12. The ADF 3 is turned upwardly around this hinge serving as the fulcrum from the document table and opened. More specifically, when the ADF 3 is turned upwardly to be opened, an upper surface of the document table 12 of the image reading apparatus 1 in FIG. 1 can be opened from the front side, so that a document which cannot be conveyed in the ADF 3 because it is not a shape of sheet, such as a book, a bound document and the like, can be set on the document table 12.

Furthermore, a document mat 35 made of an elastic material is provided on a bottom surface of the ADF 3, that is, a surface facing the document table 12.

The image reading apparatus 1 constituted as described above can read the document in three modes such as still reading mode, run reading mode and both-surface reading mode. The still reading mode is a mode in which the image of the document such as book set on the document table 12 is scanned by the light source unit 13 and the mirror unit 14 and read by the CCD reading unit 11. The run reading mode and the both-surface reading mode are modes in which the image of the document set in the document tray 22 is automatically conveyed one by one by the ADF and read. In the run reading mode, the document is read by the CCD reading unit 11, and in the both-surface reading mode, the document image is read by both the CCD reading unit 11 and the CIS 21.

According to this embodiment, the maximum number of documents which can be set in the document tray 22 is about 200, for example when the document has about the same thickness as a normal copy paper.

FIG. 2 is a block diagram showing a functional constitution of the image reading apparatus according to this embodiment. In FIG. 2, the same reference numerals and signs are allotted to the same or corresponding parts as in the constitution shown in FIG. 1 and their description is omitted.

The image reading apparatus 1 comprises a controller 41 constituted of a microcomputer and the like, by which various kinds of controls are performed. To the controller 41, detection results of the first and second document size detectors S0 and S7 for detecting the size of the document set in the document tray 22, and of the third document size detector S9 for detecting the document size set on the document table 12 are applied. The controller 41 switches the control for a sheet to be used, a timing and the like, based on the detection results of the document size detectors S0, S7 and S9.

When the document is red by the CCD reading unit 11, the controller 41 drives and controls the stepping motor 42 to move the light source unit 13 and the mirror unit 14 as described above, and controls the exposure lamp 13*a* and the CCD 11*b* in accordance with the position of the light source unit 13 detected by the light source unit detector S8 to read the image of the document.

In the meantime, when the document is read by the ADF 3, the controller 41 drives and controls the elevation/lowering motor 33 based on the detection result of the guide-in roller position detector S2, keeps a constant height of the uppermost layer of the document bundle set in the document tray 22, controls the document conveyance motor 43, the guide-in roller clutch 44 of the guide-in roller R1 and the resist roller clutch 45 of the resist rollers R8 and R9 to convey the document, and controls the CCD 11*b* and the CIS 21 to read the image of the document until the document detector S1 detects that there is no document on the document tray 22.

Furthermore, the controller 41 displays necessary information on an operation section 46 constituted by a liquid crystal touch panel or the like and receives an input through the operation section 46.

According to the image reading apparatus 1 of this embodiment, the upper surface of the document bundle set in the document tray 22 is in contact with the guide-in roller R1 in the standby state and in this state, the document can be supplied right away when needed. In this state, when the first document size detector S0 detects that the document regulating plate 30 has been operated, the controller 41 determines that the documents is added or the like, and drives and controls the elevation/lowering motor 33 to lower the document tray 22 and releases the contact between the guide-in roller R1 and the document bundle.

The lowered amount when the document tray 22 is lowered may be a value predetermined when the image reading apparatus 1 is manufactured or shipped or a value which is arbitrarily set by a service person or a user through the operation section 46 in accordance with the number of documents frequently set in the document tray 22 in the normal and general usage state.

Figure 3:
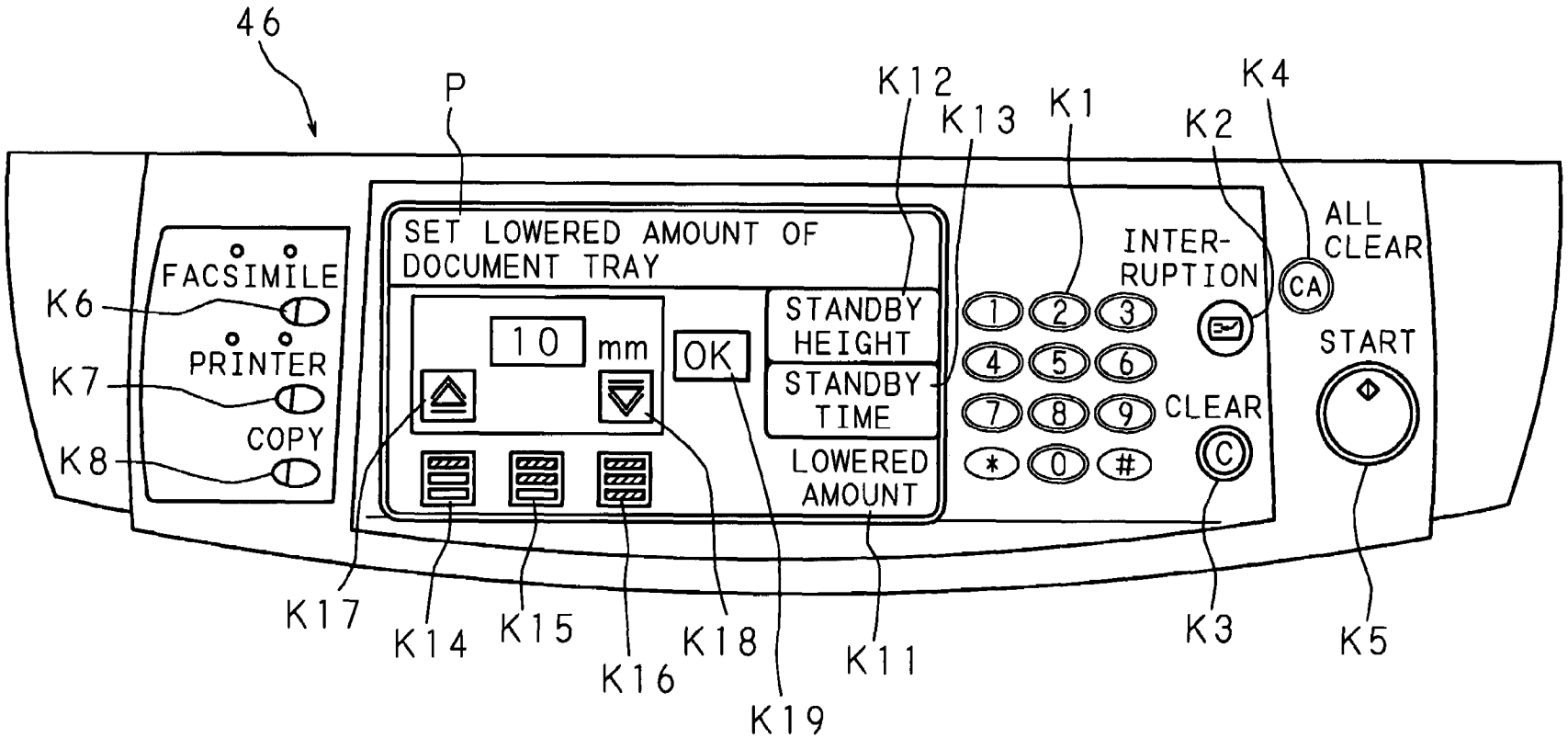
FIG. 3 is a schematic view showing a constitution example of an operation section of the image reading apparatus.

FIG. 3 is a schematic view showing a constitution example of the operation section 46 of the image reading apparatus 1. The operation section 46, which is not shown in FIG. 1, is provided on an upper surface of the image reading apparatus 1 and comprises various kinds of hardware keys (K1 to K8) and an operator control panel P constituted by a liquid crystal touch panel and the like.

According to the various kinds of the hardware keys (K1 to K8) provided in the operation section 46, reference sign K1 is a ten-key keypad for inputting numerals, reference sign K2 is a key for interrupt processing, reference sign K3 is a Clear key, reference sign K4 is an All Clear key, reference sign K5 is a Start key for starting the reading of the document and reference signs K6, K7 and K8 are function switching keys for selecting a facsimile function, a printer function and a copy function.

Since the image reading apparatus 1 according to this embodiment does not comprise facsimile communicating means for transmitting and receiving facsimile data to and from an external facsimile apparatus, nor image forming means for forming an image on a sheet or the like, the function switching keys K6 to K8 are not always necessary. However, there is a case where the image reading apparatus 1 is connected to an image forming apparatus comprising the facsimile communicating means and the image forming means as a posterior apparatus, the function switching keys K6 to K8 may be previously provided.

The operator control panel P comprises software keys. Reference signs K1 to K13 in the operator control panel P designate software keys for displaying a setting screen regarding the lowered amount of the document tray 22, a setting screen regarding the standby time and a setting screen regarding the standby height.

In the setting screen regarding the lowered amount of the document tray 22, the lowered amount of the document tray 22 when the document regulating plate 30 is operated in the state the document is set can be set. In the setting screen regarding the standby time of the document tray 22, after the operation of the document regulating plate 30 was completed, the standby time before elevation of the document tray is started can be set. In the setting screen regarding the standby height of the document tray 22, the height of default (standby height) of the document tray 22 can be set.

The example of the setting screen regarding the lowered amount of the document tray 22 is shown in FIG. 3, in which setting keys K14 through K16 for setting the lowered amount of the document tray 22 in stages and setting keys K17 and K18 for setting the lowered amount of the document tray 22 by a numeric input are shown on the operator control panel P.

The setting keys K14 through K16 are software keys which schematically show the height of the document tray 22 and used in setting the document tray 22 at an upper stage, a middle stage and a lower stage, respectively. The value of the lowered amount corresponding to each position is previously stored in a storage (not shown) and the controller 41 reads the corresponding value of the lowered amount when the document tray 22 is lowered and drives and controls the elevation/lowering motor 33 based on the lowered amount so as to lower the document tray 22 by that value. In addition, the setting keys K17 and K18 are used for setting the lowered amount of the document tray 22 by the millimeter. When the setting key K17 is pressed, the lowered amount is increased, and when the setting key K18 is pressed, the lowered amount is decreased.

When the Enter key K19 in the operator control panel P is pressed, the content set in this setting screen is stored in the above-described storage. The stored set content is read when the controller 41 drives and controls the elevation/lowering motor 33, so that the document tray 22 is lowered in accordance with the set content.

Figure 4:
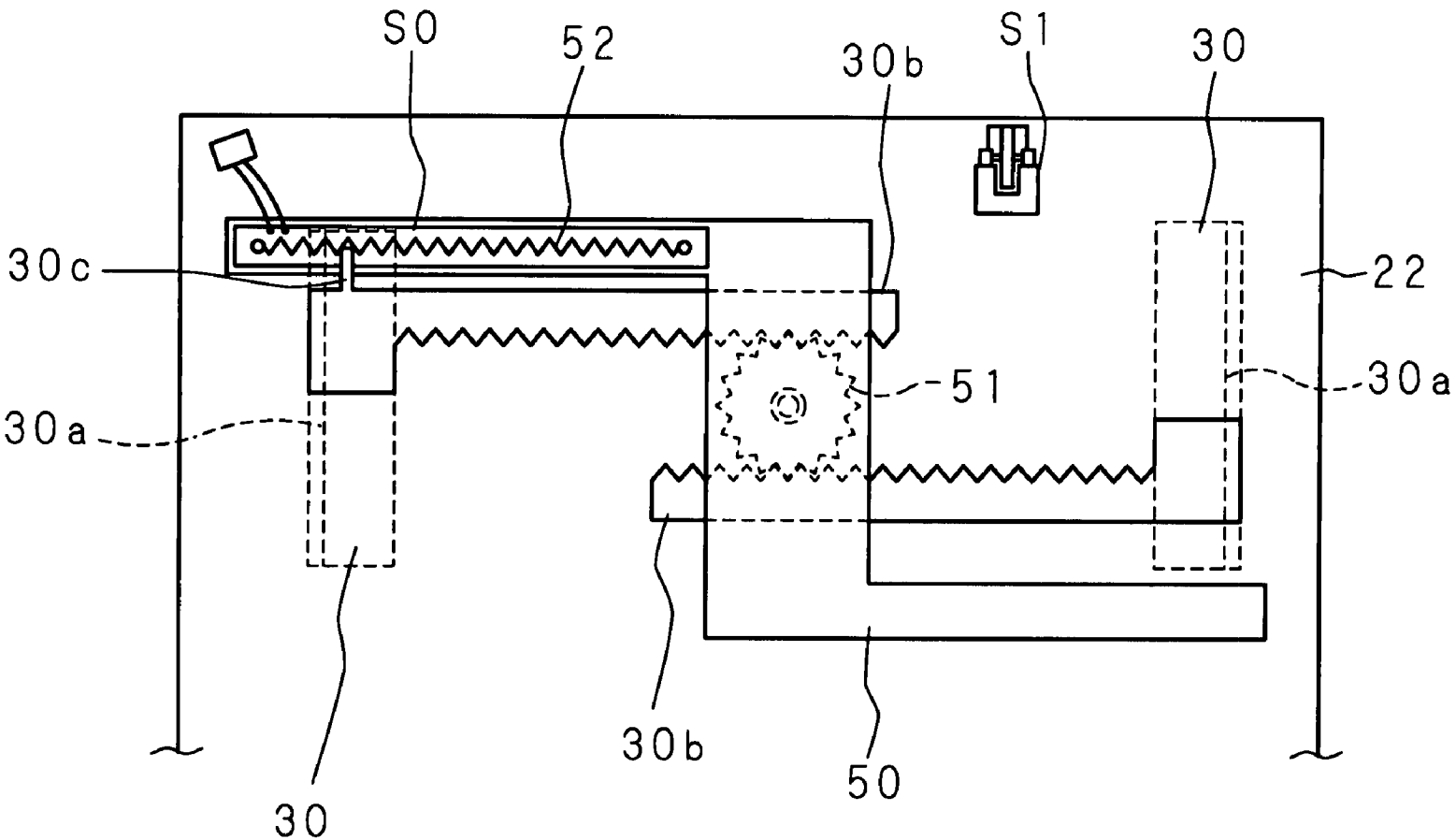
FIG. 4 is a bottom view showing a back surface of a document tray.

FIG. 4 is a bottom view showing the document tray 22 seen from a back side thereof. The document regulating plate 30 comprises a pair of side plates 30*a* for aligning both sides of the document in the main scanning direction (the direction perpendicular to the conveyance direction of the document), and a pair of rack gear portions 30*b* connected to respective ends and extended in the main scanning direction. The rack gear portions 30*b* are supported so as to be slidable on the document tray 22 by a guide member (not shown) in the main scanning direction, that is, in the direction in which the pair of side plates 30*a* approach or be separated from each other.

The pair of rack gear portions 30*b* are held by a holding member 50 and engage with a pinion gear 51 provided in the vicinity of the center of the document tray 22 so as to be opposed to each other. Therefore, when one side plate 30*a* is operated, the other side plate 30*a* is also displaced in conjunction with it.

The first document size detector S0 is constituted as disclosed in Japanese Patent Application Laid-Open No. 7-17640, for example. More specifically, a resistor 52 is arranged parallel to the rack gear portion 30*b*. A contact tongue 30*c* provided at the side plate 30*a* comes into contact with the resistor 52 and a change in a resistance value between the contact tongue 30*c* and the one end of the resistor 52 is detected, whereby the position of the side plate 30*a* is detected. The first document size detector S0 is a detector so called a slide volume system.

Figure 5A:
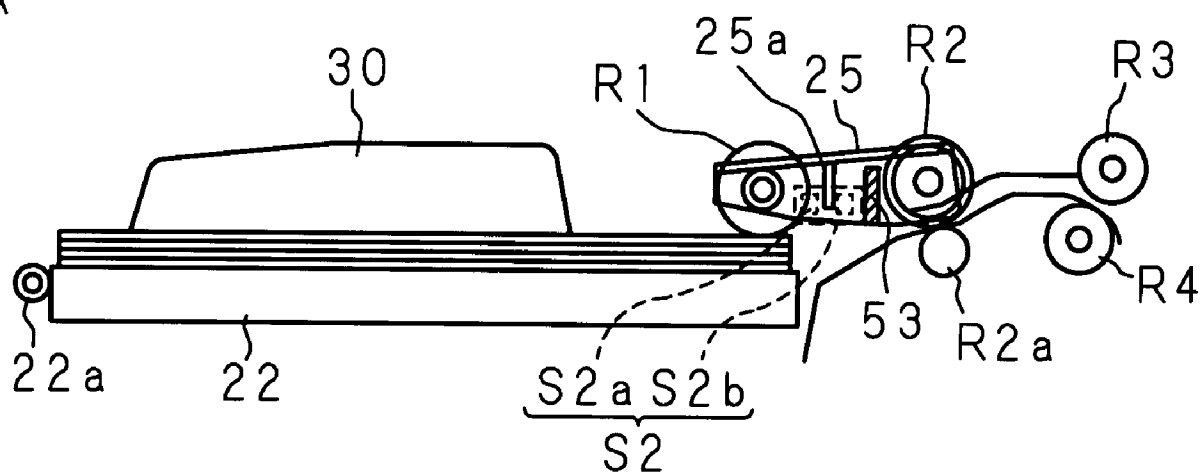
FIGS. 5A and 5B are schematic side views for explaining lowering operations of the document tray.
Figure 5B:
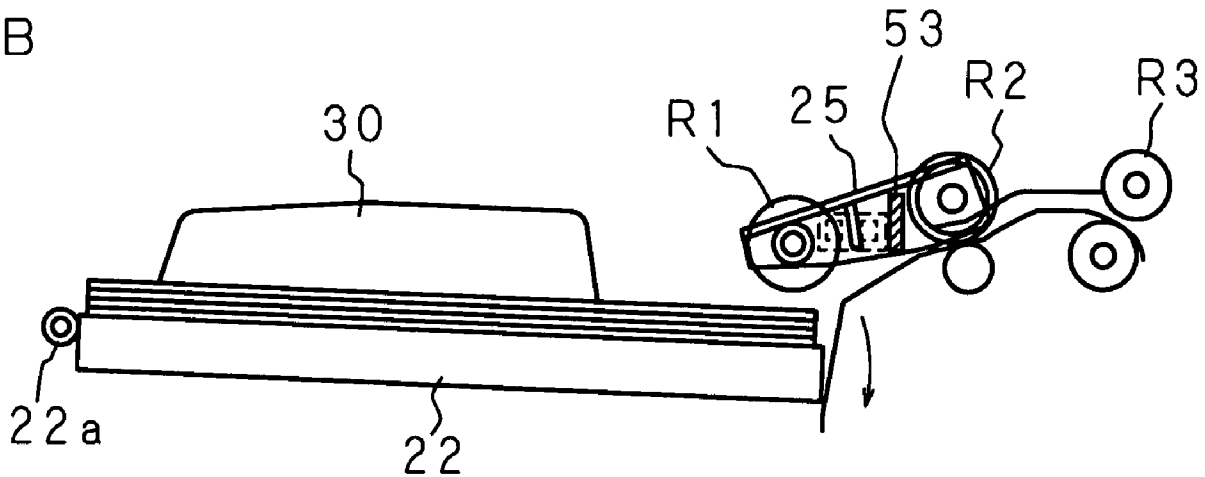

FIGS. 5A and 5B are schematic side views for explaining the lowering operation of the document tray 22. FIG. 5A shows a state in which the document tray 22 is elevated and the guide-in roller R1 is pushed up by the uppermost layer of the document bundle. The guide-in roller R1 comes in contact with the uppermost layer of the document bundle by own weights of the guide-in roller R1 and the arm 25, and in this state, the document can be supplied right away when needed.

Thus, while the guide-in roller R1 supported by the arm 25 is pushed up, a light shielding plate 25*a* provided at the arm 25 does not shield a light path between a pair of light emitting element S2*a* and light receiving element S2*b* of the guide-in roller position detector S2 provided at a fixed position, so that the above state can be detected when the light path between the two elements S2*a* and S2*b* is formed. In other words, the document tray 22 is elevated until the light path between the two elements S2*a* and S2*b* is formed and a time when the state of the light path is changed from the shielded state to the not-shielded state is detected. The controller 41 elevates the document tray 22 until the light path between the two elements S2*a* and S2*b* is formed while the document can be supplied immediately when needed and the document is being supplied, and then stops the elevation/lowering motor 33 to hold the upper surface height of the document bundle at the predetermined height.

In the meantime, when the document tray 22 is lowered by the operation of the document regulating plate 30, as shown in FIG. 5B, the guide-in roller is separated from the uppermost layer of the document bundle and the arm 25 contacts a stopper 53 to be held. In this state, the light path between the light emitting element S2*a* and the light receiving element S2*b* is shielded by the light shielding plate 25*a* and the light path between the two elements S2*a* and S2*b* is shielded. In other words, when irradiated light from the light emitting element S2*a* is not detected by the light receiving element S2*b*, it can be determined that the guide-in roller R1 is separated from the uppermost layer of the document bundle.

Hereinafter, the operations of the image reading apparatus 1 constituted as described above are described using a flowchart.

Figure 6:
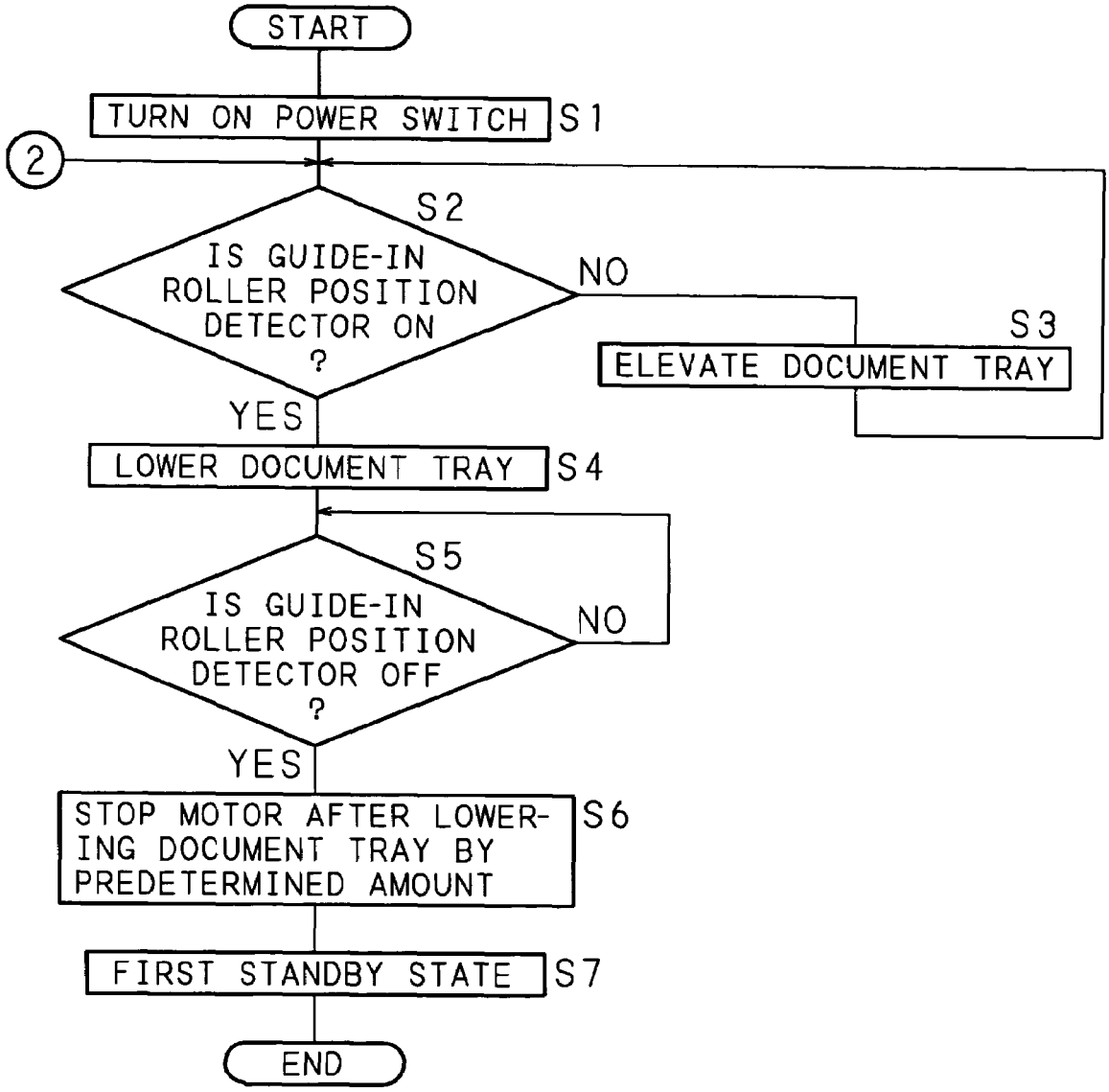
FIG. 6 is a flowchart for explaining control procedures of a controller from a time when a power is turned on up to a time when the document tray is put into a standby state.

FIG. 6 shows a flowchart for describing control procedures of the controller 41 until the document tray 22 is put into the standby state after a power was turned on. First, when a power switch (not shown) is ON (step S1), the controller 41 determines whether the output of the guide-in roller position detector S2 is ON or not, that is, whether the light path between the elements S2*a* and S2*b* is formed or not (step S2).

When it is determined that the output of the guide-in roller position detector S2 is not ON (NO in step S2), the controller 41 drives and controls the elevation/lowering motor 33 to elevate the document tray 22 (step S3). When the document tray 22 is elevated and the guide-in roller R1 is pushed up and the light path between the elements S2*a* and S2*b* is formed, in other words, when it is determined that the output of the guide-in roller position detector S2 is ON (YES in step S2), the controller 41 drives and controls the elevation/lowering motor 33 to start to lower the document tray 22 (step S4).

Then, the controller 41 sequentially determines whether the output of the guide-in roller position detector S2 is OFF or not (step S5) and waits until the output of the guide-in roller position detector S2 is turned off (NO in step S5). During this time, the controller 41 continuously drives and controls the elevation/lowering motor 33 to lower the document tray 22.

When it is determined that the output of the guide-in roller position detector S2 is OFF (YES in step S5), the controller 41 drives the elevation/lowering motor 33 by a predetermined number of steps from that state so as to lower the document tray 22 to a position of a first standby state and then stops the motor 33 (step S6) and holds the document tray 22 at that position (step S7). Here, the first standby state is a state before the document is set and the height position of the document tray 22 is previously set by the service person or the user by operating the operation section 46 in accordance with the number of documents frequently set in the document tray 22, as described above. In this state, the controller 41 stops the control once.

Figure 7:
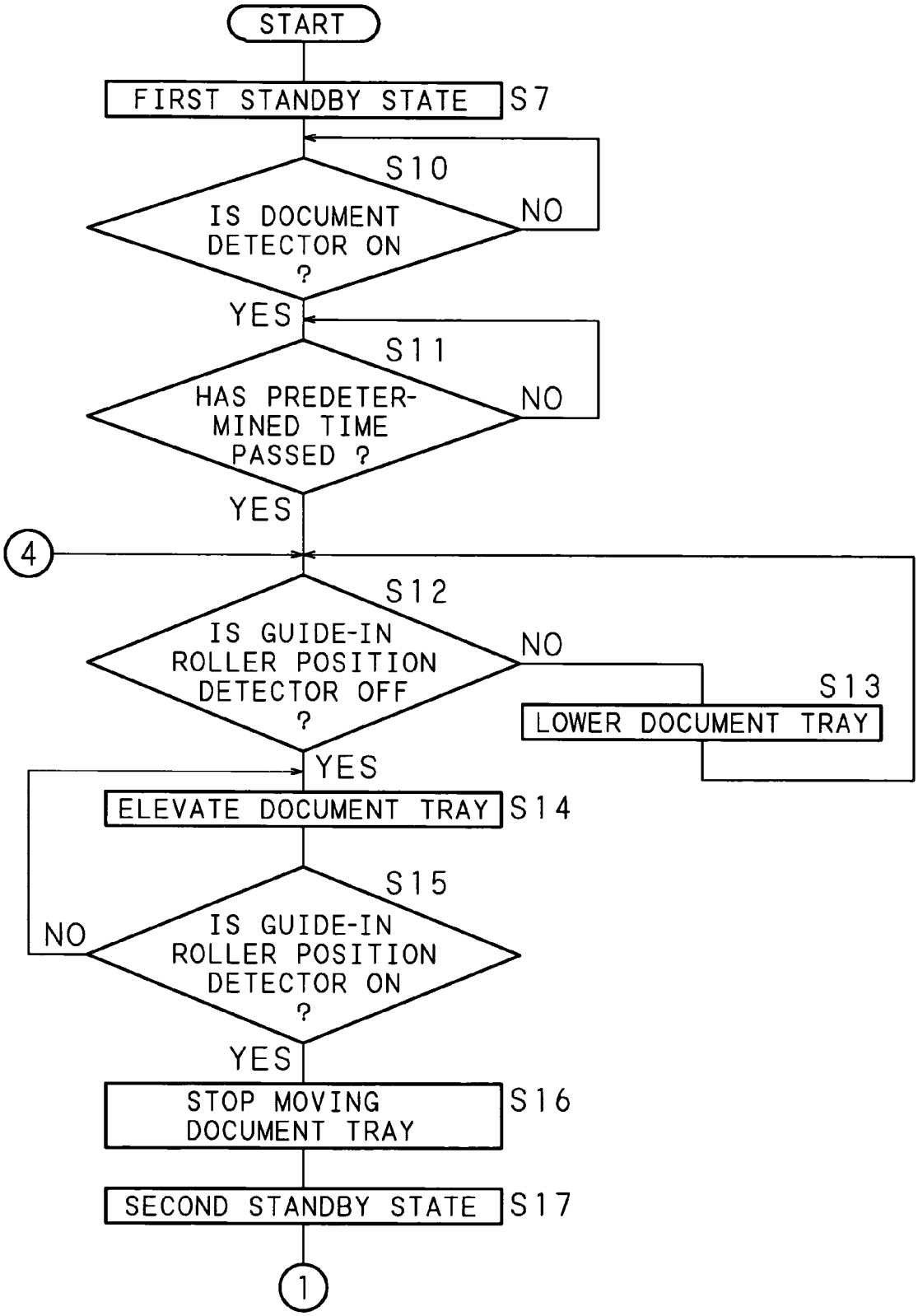
FIGS. 7 through 9 are flowcharts showing control procedures from a time when document is set up to a time when the document is read.
Figure 8:
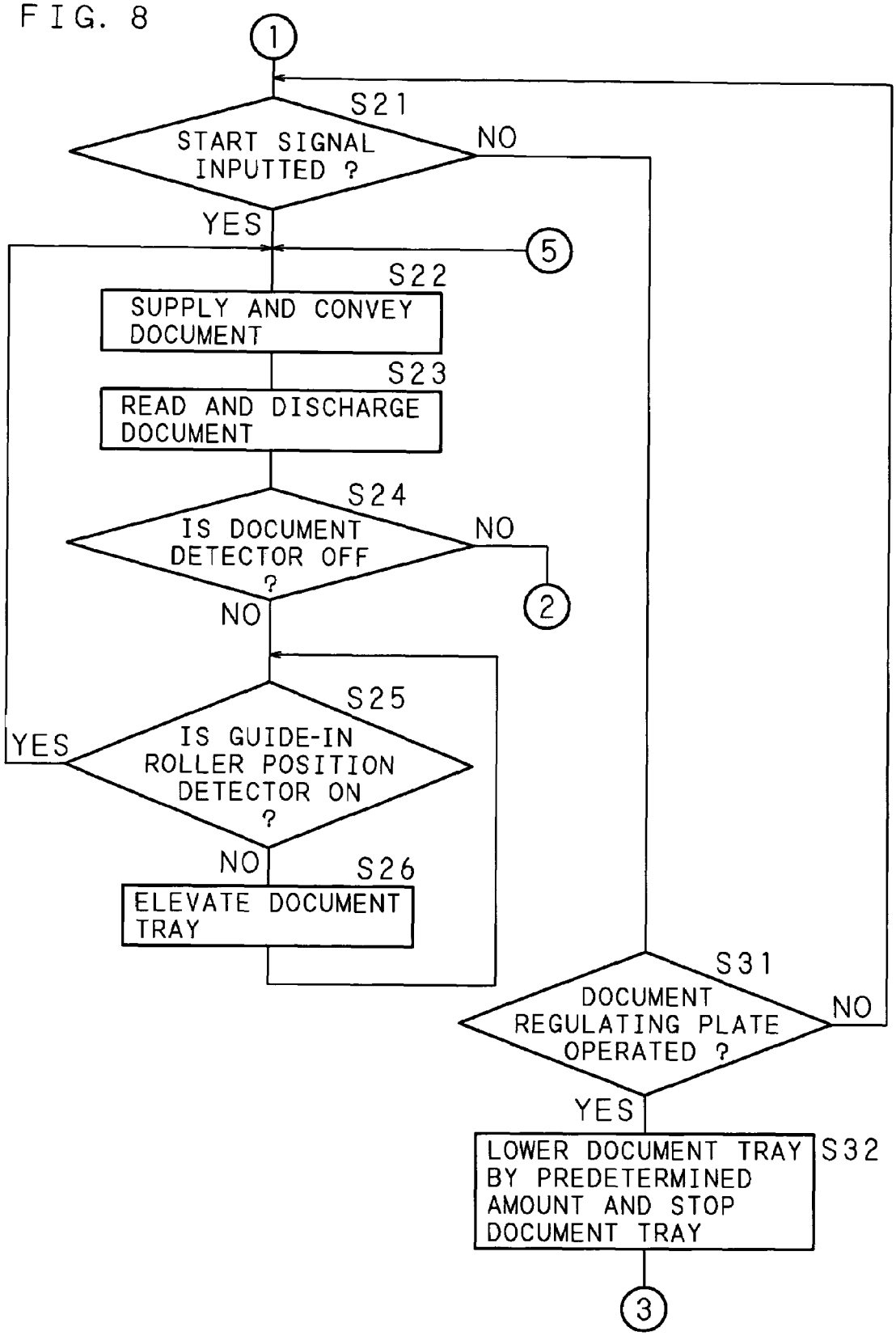
Figure 9:
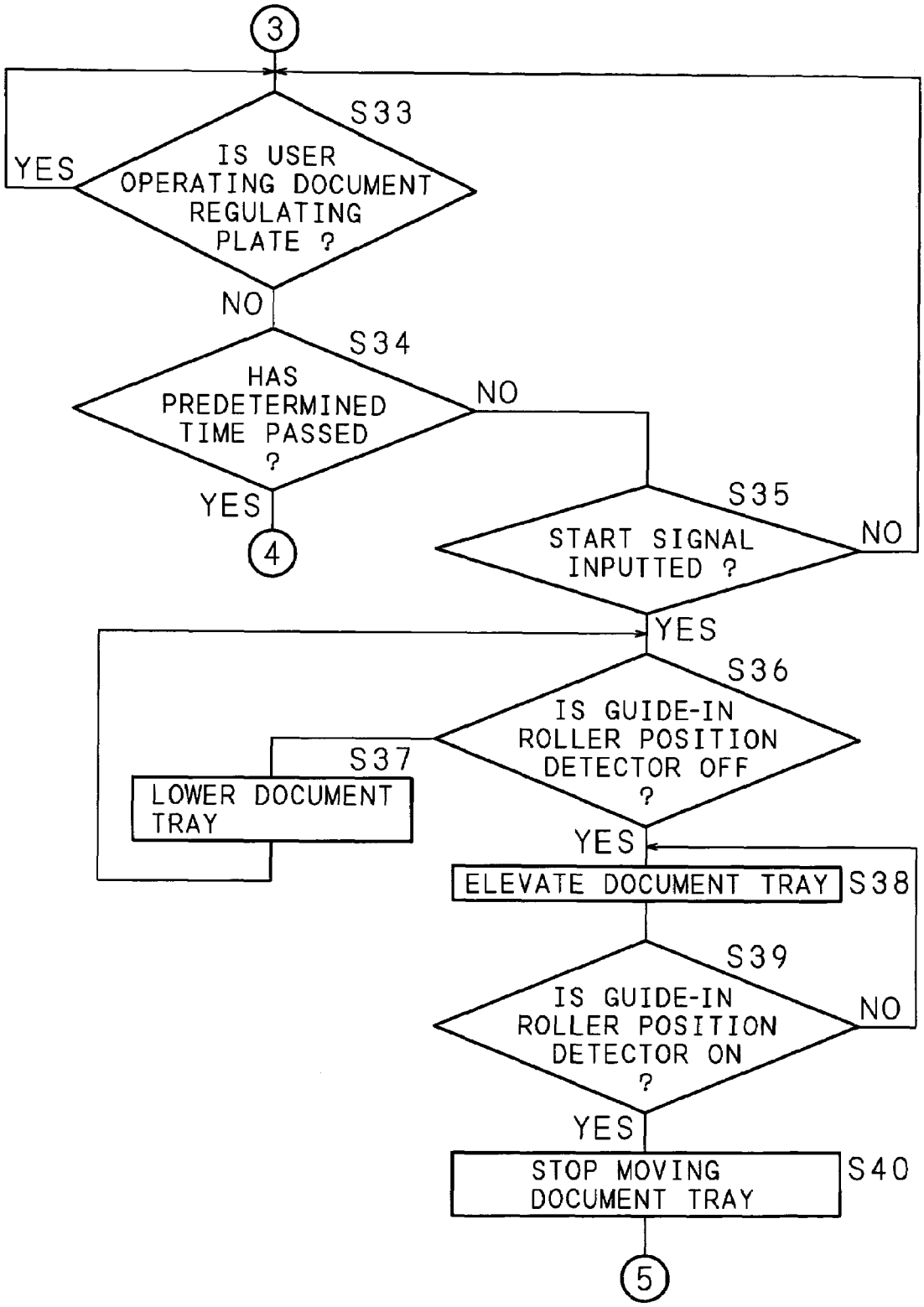

FIGS. 7 through 9 show flowcharts showing control procedures from the document setting to the document reading. Here, FIG. 7 shows control procedures of the controller 41 until the document tray 22 is put into a second standby state to be describe later after the document was set, and it is assumed that the document tray 22 is in the first standby state as described above (step S7).

First, the controller 41 determines whether the output of the document detector S1 is ON or not (step S10) to determine whether the document is set in the document tray 22 or not. When the output of the document detector S1 is OFF (NO in step S10), it is determined that the document is not set in the document tray 22 and waits until the document is set.

When it is determined that the output of the document detector S1 is ON (YES in step S10), a timer (not shown) starts to count an elapse of time after the output of the document detector S1 was turned on, and it is determined whether a predetermined time has passed or not (step S11). While the predetermined time has not passed yet (NO in step S11), the controller 41 waits until the predetermined time passes. The predetermined time is previously set in order to provide a time necessary for the user to confirm and align the document.

When the predetermined time passed (YES in step S11), the controller 41 determines whether the output of the guide-in roller position detector S2 is OFF or not (step S12). When it is not OFF (NO in step S12), in other words, when the guide-in roller R1 is in contact with the document at the height position (the first standby state) of the document tray 22 at the time because the document bundle is thick, the document tray 22 is lowered by the predetermined amount (step S13) and the operation is returned to step S12.

Thus, by recurrently repeating the operations in steps S12 and S13, even when the documents whose number is larger than the predetermined number are forced to set on the document tray 22 to some extent, the controller 41 can confirm whether the guide-in roller R1 is higher than the predetermined height for supplying and conveying the document. When the height position of the guide-in roller R1 is too higher than the predetermined height, which could hinder the supply and conveyance of the document, the document tray 22 is lowered by the predetermined amount.

When it is determined that the output of the guide-in roller position detector S2 is OFF (YES in step S12), the controller 41 starts to elevate the document tray 22 (step S14) and determines whether the output of the guide-in roller position detector S2 is ON or not (step S15). When the output of the guide-in roller position detector S2 is not ON (NO in step S15), the operation is returned to step S14. In other words, the document tray 22 continues to be elevated until the output of the guide-in roller position detector S2 is turned on.

When the output of the guide-in roller position detector S2 is ON (YES in step S15), the controller 41 stops moving the document tray 22 (step S16). Thus, the document tray 22 is stopped and is put into in the second standby state (step S17).

In the second standby state, the document setting is completed and the document can be supplied and conveyed when needed. The height position of the document tray 22 is the height actually corresponding to the number of documents set in the document tray 22 at that time.

FIGS. 8 and 9 show control procedures of the controller 41 before the document is read after the document tray 22 was put into the second standby state.

As described above, when the document tray 22 is put into the second standby state, the controller 41 determines whether the start key K5 on the operation section 46 is pressed and a start signal is inputted or not (step S21). When the start signal is not inputted (NO in step S21), the controller 41 determines whether the document regulating plate 30 is operated or not (step S31). When the document regulating plate 30 is not operated (NO in step S31), the controller 41 returns the operation to step S21 and waits until the next operation following the document setting is performed.

In addition, the operation of the document regulating plate 30 means that after the user set the document in the document tray 22, the user slides the document regulating plate 30 along the document tray 22 in order to regulate and align the side of the document bundle.

When the start signal is inputted (YES in step S21), the controller 41 supplies and conveys the document (step S22), reads the image of the document and discharge the document onto the sheet discharge tray 17 (step S23). During this time, the controller 41 determines whether the output of the document detector S1 is OFF or not (step S24) to determine whether there is a document in the document tray 22 or not.

When it is determined that the output of the document detector S1 is OFF (YES in step S24) and it is determined that there is no document, the controller 41 returns the operation to step S2. At this time, the document tray 22 is returned to the first standby state.

When the output of the document detector S1 is not OFF (NO in step S24), in other words, when the document exists in the document tray 22, the controller 41 determines whether the output of the guide-in roller position detector S2 is ON or not (step S25).

When the output of the guide-in roller position detector S2 is OFF (NO in step S25), in other words, when the height of the guide-in roller R1 is lowered as the height of the document bundle is lowered, the controller 41 elevates the document tray 22 by the predetermined amount (step S26). Then, the operation is returned to step S25 and the document tray 22 is elevated until the output of the guide-in roller position detector S2 is turned on.

When the output of the guide-in roller position detector S2 is ON (YES in step S25), the controller 41 returns the operation to step S22 and supplies and conveys the document and performs the reading operation of the document.

Thus, while the document tray 22 is elevated to keep the height of the uppermost layer of the document bundle constant as the document on the document tray 22 is taken in, the document is supplied in step S22 and read in step S23.

In the meantime, when it is determined that the document regulating plate 30 has been operated in step S31 (YES in step S31), it is determined that a new document is to be added on the document tray 22 or the like and the controller 41 lowers the document tray 22 by the predetermined amount and stops it (step S32). Here, the lowered amount of the document tray 22 by the controller 41 is equal to the value set by the user through the operator control panel P as described in FIG. 3 (or to the default value previously set at the time of shipment if the value is not set by the user).

Then, the controller 41 determines whether the user is operating the document regulating plate 30 or not (step S33). When the document regulating plate 30 is being operated (YES in step S33), the controller 41 waits until the operation of the document regulating plate 30 is completed. When the operation of the document regulating plate 30 is completed (NO in step S33), it is determined whether the predetermined time has passed from the time when the operation of the document regulating plate 30 was completed or not (step S34). When the predetermined time passed, the operation is returned to step S12. In this case, the document tray 22 is controlled by the controller 41 as described above and the document tray 22 is at the height (the second standby state) actually corresponds to the number of the documents set in the document tray 22 at that time.

In the meantime, while the predetermined time has not yet passed in step S34 (NO in step S34), the controller 41 determines whether the start signal has been inputted by pressing the start key K5 in the operation section 46 or not (step S35). When the start signal has not been inputted (NO in step S35), the controller 41 returns the operation to step S33 and determines whether the document regulating plate 30 is being operated or not again.

When the start signal is inputted within the predetermined time after the operation of the document regulating plate 30 was completed (YES in step S35), the controller 41 performs the same operations from step S12 thorough step S16. In other words, the controller 41 determines whether the output of the guide-in roller position detector S2 is OFF or not (step S36). When it is not OFF (NO in step S36), the controller 41 lowers the document tray 22 by the predetermined amount (step S37) and returns the operation to step S36.

When it is determined that the output of the guide-in roller position detector S2 is OFF (YES in step S36), the controller 41 starts to elevate the document tray 22 (step S38) and determines whether the output of the guide-in roller position detector S2 is ON or not (step S39). When the output of the guide-in roller position detector S2 is OFF (NO in step S39), the operation is returned to step S38.

When the output of the guide-in roller position detector S2 is ON (YES in step S39), the controller 41 stops moving the document tray 22 (step S40). Thus, the height position of the document tray 22 has the height actually corresponding to the number of the documents set at that time. Then, the operation is returned to step S22 and starts to supply and convey the document.

Thus, according to the image reading apparatus 1 of this embodiment, the document tray 22 is lowered when the document regulating plate 30 of the document tray 22 is operated in the state in which the guide-in roller R1 is in contact with the uppermost layer of the document bundle and the document can be supplied. Therefore, the document can be added as well as the document can be reduced, the set position of the document can be corrected (aligned again) and the processing can be stopped. When the above operations are to be performed, the set state is canceled by only operating the document regulating plate 30 so that the above operations can be easily performed. In addition, since the guide-in roller R1 is separated from the uppermost layer of the document by the operation of the document regulating plate 30, the document is prevented from being contaminated and the guide-in roller or the like is prevented from being damaged.

Furthermore, since the slide volume in which a resistance value is changed continuously corresponding to the displacement portion of the document regulating plate 30 is used as the first document size detector S0 for detecting the size of the document set in the document tray 22, the operation of the document regulating plate 30 for adding or reducing the document can be detected and the first document size detector S0 can be used also in detecting the operation of the document regulating plate 30, unlike the light sensor or the like in which a detection output is obtained only at the defined size position.

Still further, when the document tray 22 is elevated as the predetermined time has passed after the document was set and the document is put into the state it can be supplied and conveyed in a case where the document is pulled out by force, the document detector S1 detects that there is no document and the controller 41 controls the height position of the document tray 22 to put it into the first standby state.

Still further, the document tray 22 may be lowered to the first standby state once in a case where the start signal is not inputted for the predetermined time (several minutes, for example) or more after the document was set and the document tray 22 was put into the second standby state. Besides, the predetermined time can be set through the operator control panel P of the operation section 46 within a range of one to several seconds, for example.

Furthermore, the position of the document tray 22 may be changed from the first standby state to the second standby state using any key operation of the operation section 46 as a trigger in addition to the time passage.

Still further, although the flowchart in FIG. 6 explaining the procedure from the time the power is turned on to the first standby state shown is described by a method in which a detector for directly detecting the position of the document tray 22 is not used, the height of the document tray 22 may be controlled using the detector for directly detecting the position of the document tray 22. For example, a detector for detecting the lowest point of the document tray 22 is provided and the document tray 22 may be elevated to the position in the predetermined first standby state based on a detection signal from the detector, or a detector for detecting the highest point of the document tray 22 may be used. Although the height of the document tray 22 in the initial state (when the power is turned on) is the lowest point in general in which a loading capacity is the maximum, it may be set at any middle height.

Still further, according to this embodiment, in the case where the document regulating plate 30 was operated at the time of completion of the document setting, the document tray 22 is lowered. However, it is needless to say that the same effect can be provided in a case where an elevation/lowering mechanism section and an elevation/lowering motor are provided at the arm 25 having the guide-in roller R1 and the uppermost layer of the document and the guide-in roller R1 are separated by elevating the arm 25 when the document regulating plate 30 was operated.

Second Embodiment

Although a sheet feeding apparatus of the present invention is applied to an image reading apparatus in the first embodiment, it can be applied to an image forming apparatus such as a printer, a complex machine having a scanner function, a printer function and a facsimile function, and the like. According to this embodiment, a description is made of a case where the present invention is embodied as an image forming apparatus.

Figure 10:
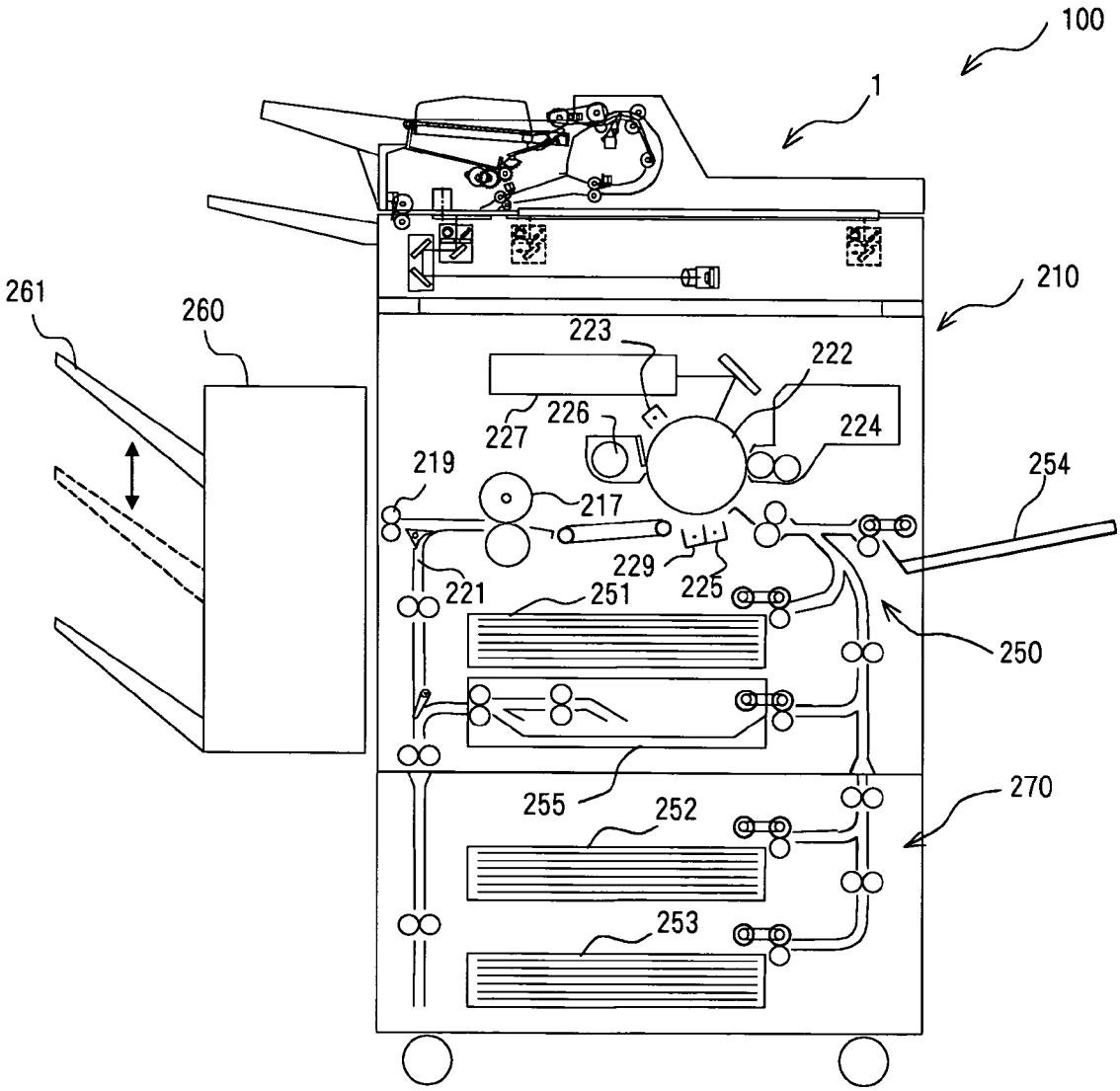
FIG. 10 is a vertical sectional view showing a schematic constitution of an image forming apparatus according to the embodiment of the present invention.

FIG. 10 is a vertical sectional view showing a schematic constitution of an image forming apparatus according to this embodiment. An image forming apparatus 100 of this embodiment comprises the above-described image reading apparatus 1, an image forming unit 210 for forming an image on a sheet, a posttreatment unit 260 for performing a posttreatment on the image-formed sheet, and a sheet feeding unit 270 for supplying and conveying the sheet to the image forming unit 210. The image forming unit 210 is provided under the image reading apparatus 1. The posttreatment unit 260 and the sheet feeding unit 270 are provided at a side portion and a lower portion of the image forming unit 210, respectively.

In addition, the image reading apparatus 1 has a function of reading an image on the document. Since its constitution and operation are the same as described above, description thereof is omitted.

The image forming unit 210 has a function of forming an image on a sheet supplied from the sheet feeding unit 270, based on image data obtained by reading the image of the document by the image reading apparatus 1, or image data transferred from an external information processing apparatus (not shown).

More specifically, after the above-described image data is sent to an image processing section (not shown) and predetermined image processing is performed thereon, it is stored in an image memory in the image processing section once, sequentially read at a predetermined timing and transferred to a laser writing unit 227 serving as an optical writing apparatus.

The laser writing unit 227 comprises a semiconductor laser light source which emits laser according to the image data transferred from the image memory, a polygon mirror which deflects the laser at a constant angular velocity, and an f-θ lens for correcting the laser which was deflected at the constant angular velocity so that is may be deflected at the constant angular velocity on a photoconductor drum 222.

In addition, although the laser writing unit is used as the optical writing apparatus in this embodiment, a fixed scanning type of optical writing head unit using a light emitting element array such as an LED (Light Emitting Diode) or an EL (Electro Luminescence) may be used.

Arranged around the photoconductor drum 222 are an electrizer 223 for electrizing the photoconductor drum 222 to a predetermined potential, a developing device 224 for supplying toner to an electrostatic latent image formed on the photoconductor drum 222 to develop it, a transfer device 225 for transferring the toner image formed on the surface of the photoconductor drum 222 to the conveyed sheet, a neutralizer 229 for removing charges from the sheet onto which the toner image was transferred to peel the sheet from the photoconductor drum 222, and a cleaning device for collecting toner left after the toner image was transferred.

The sheet on which the image was transferred is conveyed to a fixing unit 217 and the image is fixed onto the sheet by the fixing unit 217. The sheet on which the image is fixed is discharged outside by a sheet discharge roller 219.

The posttreatment unit 260 for performing a stapling operation, saddle-folding operation and the like onto the sheet on which the image is formed is provided downstream of the sheet discharge roller 219 in the sheet conveyance direction. The predetermined posttreatment is performed on the sheet in the posttreatment unit 260 and then the sheet is discharged onto the elevation/lowering tray 261.

Furthermore, the image forming unit 210 comprises a sheet tray 251 and a manual feed tray 254 for taking in given sheet from the outside. The sheet supplied from the sheet tray 251 or the manual feed tray 254 is conveyed by sheet conveying means 250 to an image transferring position in which the photoconductor drum 222, the transfer device 225 and the like are arranged.

In addition, a switchback path 221 used for forming the image again on the back surface of the sheet is provided downstream of the fixing unit 217 in the sheet conveyance direction. The sheet converted by the switchback path 221 is supplied to the sheet conveying means 250 again through a double-side unit 255. The switchback path 221 and the double-side unit 255 are used not only for forming the image on both sides of the sheet but also for discharging the sheet with the surface reversed.

The sheet feeding unit 270 is disposed under the above image forming unit 210 and comprises a plurality of sheet cassettes 252 and 253 leading to the sheet conveying means 250 of the image forming unit 210 so that it contains a large amount of sheets having different sizes.

A controller (not shown) for operating the above parts in conjunction with each other is mounted on the image forming apparatus 100 in order to perform the image forming operation on the sheet supplied from the sheet feeding unit 270 to the image forming unit 210, based on the image of the document read by the image reading apparatus 1.

In addition, although the operation section 46 is mounted on the image reading apparatus 1 in the first embodiment, it is needless to say that it can be provided at any position of the image forming unit 210.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A sheet feeding apparatus comprising:

a sheet container for containing a plurality of stacked sheets;

an elevation/lowering driving unit for elevating and lowering the sheet container;

a sheet conveying unit for sequentially taking out the sheets from an uppermost layer put in contact with the sheet conveying unit by elevating the sheet container by the elevation/lowering driving unit and conveying the sheets to a predetermined conveyance path;

a regulating unit provided so as to be slidable on the sheet container for regulating a set position of a sheet;

a position detector for detecting a position of the regulating unit; and a contact detector for detecting a contact state between the uppermost layer of the sheets contained in the sheet container and the sheet conveying unit, wherein the elevation/lowering driving unit lowers the sheet container when a change in the position of the regulating unit is detected by the position detector in a state in which the uppermost layer of the sheets contacts the sheet conveying unit;

and further comprising:

a receiving unit for receiving information input externally for setting a lowered amount of the sheet container; and a storage for storing the received information, wherein the elevation/lowering driving unit lowers the sheet container by the lowered amount stored in the storage when the position detector detects a change in the position of the regulating unit.

2. The sheet feeding apparatus according to claim 1, wherein the elevation/lowering driving unit lowers the sheet container until the uppermost layer of the sheets and the sheet conveying unit are separated when the position detector detects a change in the position of the regulating unit.

3. The sheet feeding apparatus according to claim 1, further comprising a measuring unit for measuring a dimension of a sheet contained in the sheet container based on a detection result of the position detector.

4. The sheet feeding apparatus according to claim 1, further comprising a clocking unit, wherein the elevation/lowering driving unit elevates the sheet container when a change in the position of the regulating unit is not detected for a predetermined time.

5. A sheet feeding apparatus comprising:

sheet containing means for containing a plurality of stacked sheets;

elevation/lowering driving means for elevating and lowering the sheet containing means;

sheet conveying means for sequentially taking out the sheets from an uppermost layer put in contact with the sheet conveying means by elevating the sheet containing means by the elevation/lowering driving means and conveying the sheets to a predetermined conveyance path;

regulating means provided so as to be slideable on the sheet containing means for regulating a set position of a sheet;

position detecting means for detecting a position of the regulating means; and contact detecting means for detecting a contact state between the uppermost layer of the sheets contained in the sheet containing means and the sheet conveying means, wherein the elevation/Lowering driving means lowers the sheet containing means when a change in the position of the regulating means is detected by the position detecting means in a state in which the uppermost layer of the sheets contacts the sheet conveying means;

and further comprising:

a receiving unit for receiving information input externally for setting a lowered amount of the sheet container; and a storage for storing the received information, wherein the elevation/lowering driving unit lowers the sheet container by the lowered amount stored in the storage when the position detector detects a change in the position of the regulating unit.

6. The sheet feeding apparatus according to claim 5, wherein the elevation/lowering driving means lowers the sheet containing means until the uppermost layer of the sheets and the sheet conveying means are separated when the position detecting means detects a change in the position of the regulating means.

7. The sheet feeding apparatus according to claim 5, further comprising measuring means for measuring a dimension of a sheet contained in the sheet containing means based on a detection result of the position detecting means.

8. The sheet feeding apparatus according to claim 5, further comprising clocking means, wherein the elevation/lowering driving means elevates the sheet containing means when a change in the position of the regulating means is not detected for a predetermined time.

9. An image reading apparatus comprising:

a sheet container for containing a plurality of stacked sheets;

an elevation/lowering driving unit for elevating and lowering the sheet container;

a sheet conveying unit for sequentially taking out the sheets from an uppermost layer put in contact with the sheet conveying unit by elevating the sheet container by the elevation/lowering driving unit and conveying the sheets to a predetermined conveyance path;

an image reading unit for reading an image on a sheet conveyed by the sheet conveying unit;

a regulating unit provided so as to be slidable on the sheet container for regulating a set position of a sheet;

a position detector for detecting a position of the regulating unit; and a contact detector for detecting a contact state between the uppermost layer of the sheets contained in the sheet container and the sheet conveying unit, wherein the elevation/lowering driving unit lowers the sheet container when a change in the position of the regulating unit is detected by the position detector in a state in which the uppermost layer of the sheets contacts the sheet conveying unit;

and further comprising:

a receiving unit for receiving information input externally for setting a lowered amount of the sheet container; and a storage for storing the received information, wherein the elevation/lowering driving unit lowers the sheet container by the lowered amount stored in the storage when the position detector detects a change in the position of the regulating unit.

10. The image reading apparatus according to claim 9, wherein the elevation/lowering driving unit lowers the sheet container until the uppermost layer of the sheets and the sheet conveying unit are separated when the position detector detects a change in the position of the regulating unit.

11. The image reading apparatus according to claim 9, further comprising a measuring unit for measuring a dimension of a sheet contained in the sheet container based on a detection result of the position detector.

12. The image reading apparatus according to claim 9, further comprising a clocking unit, wherein the elevation/lowering driving unit elevates the sheet container when a change in the position of the regulating unit is not detected for a predetermined time.

13. An image forming apparatus comprising:

a sheet container for containing a plurality of stacked sheets;

an elevation/lowering driving unit for elevating and lowering the sheet container;

a sheet conveying unit for sequentially taking out the sheets from an uppermost layer put in contact with the sheet conveying unit by elevating the sheet container by the elevation/lowering driving unit and conveying the sheets to a predetermined conveyance path;

an image forming unit for forming an image on a sheet conveyed by the sheet conveying unit;

a regulating unit provided so as to be slidable on the sheet container for regulating a set position of a sheet;

a position detector for detecting a position of the regulating unit; and a contact detector for detecting a contact state between the uppermost layer of the sheets contained in the sheet container and the sheet conveying unit, wherein the elevation/lowering driving unit lowers the sheet container when a change in the position of the regulating unit is detected by the position detector in a state in which the uppermost layer of the sheets contacts the sheet conveying unit;

and further comprising:

a receiving unit for receiving information input externally for setting a lowered amount of the sheet container; and a storage for storing the received information, wherein the elevation/lowering driving unit lowers the sheet container by the lowered amount stored in the storage when the position detector detects a change in the position of the regulating unit.

14. The image forming apparatus according to claim 13, wherein the elevation/lowering driving unit lowers the sheet container until the uppermost layer of the sheets and the sheet conveying unit are separated when the position detector detects a change in the position of the regulating unit.

15. The image forming apparatus according to claim 13, further comprising a measuring unit for measuring a dimension of a sheet contained in the sheet container based on a detection result of the position detector.

16. The image forming apparatus according to claim 13, further comprising a clocking unit, wherein the elevation/lowering driving unit elevates the sheet container when a change in the position of the regulating unit is not detected for a predetermined time.

* * * * *